US012788157B1

(12) United States Patent
Nagel et al.

(10) Patent No.: US 12,788,157 B1
(45) **Date of Patent: *Nov. 10, 2026**

(54) PULL-OUT TRAY FOR SHELVING

(71) Applicant: Fasteners for Retail, Inc., Twinsburg, OH (US)

(72) Inventors: Thomas O. Nagel, Rockford, IL (US); Kelly Ann Pickett, Rockford, IL (US)

(73) Assignee: Fasteners for Retail, Inc., Twinsburg, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/040,010

(22) Filed: Jan. 29, 2025

Related U.S. Application Data

(63) Continuation of application No. 18/466,518, filed on Sep. 13, 2023, now Pat. No. 12,245,706.

(51) Int. Cl.

| | |
|---|---|
| ***A47F 1/08*** | (2006.01) |
| ***A47F 1/12*** | (2006.01) |
| *A47F 5/00* | (2006.01) |

(52) U.S. Cl.
CPC ..... *A47F 1/08* (2013.01); *A47F 1/126* (2013.01); *A47F 5/0025* (2013.01); *A47F 5/005* (2013.01)

(58) Field of Classification Search
CPC .. A47F 1/08; A47F 1/126; A47F 5/005; A47F 1/12; A47F 1/04; A47F 1/125; A47F 5/0025; A47F 2005/165; A47F 5/132; A47F 1/121; A47F 5/16; A47B 57/58; A47B 96/021
See application file for complete search history.

(56) References Cited

U.S. PATENT DOCUMENTS

| | | | |
|---|---|---|---|
| 546,499 | A | 9/1895 | Warren |
| 1,120,941 | A | 12/1914 | Jones |
| 1,285,890 | A | 11/1918 | Anderson |
| 1,395,621 | A | 11/1921 | Wheatley |
| 1,676,908 | A | 7/1928 | Levene |
| 1,902,451 | A | 3/1933 | Johnson |
| 2,371,917 | A | 3/1945 | Rosenberg |
| 2,779,114 | A | 1/1957 | Orthwine |
| 3,625,371 | A | 12/1971 | Dill |
| 4,282,977 | A | 8/1981 | Di Lorenzo |
| 4,395,955 | A | 8/1983 | Pfeifer |
| 4,471,512 | A | 9/1984 | Thalenfeld |
| D290,201 | S | 6/1987 | Wilder |

(Continued)

*Primary Examiner* — Devin K Barnett
(74) *Attorney, Agent, or Firm* — Reinhart Boerner Van Deuren P.C.

(57) ABSTRACT

A retail merchandise tray system includes a pusher tray which includes a pusher tray. The pusher tray includes a pair of opposed load bearing members, a front stop mounted to the pair of load bearing members, and a wire support frame supported at least in part by the pair of load bearing members. The pusher tray further includes a pusher mounted to the wire support frame. The pusher is movable along the wire support frame toward and away from the front stop along a first axis. The retail merchandise tray system further includes a base configured for removable attachment to the pusher tray. The base is further configured for attachment to a retail shelf. The attachment of the pusher tray to the base is such that the pusher tray is configured to slide back and forth between a loading configuration and a dispensing configuration.

19 Claims, 14 Drawing Sheets

(56) References Cited

U.S. PATENT DOCUMENTS 4,773,348 A 9/1988 Rowley
4,911,309 A 3/1990 Stefan
5,123,546 A * 6/1992 Crum ..... A47F 1/126 206/556
5,190,186 A 3/1993 Yablans et al.
5,255,802 A 10/1993 Krinke et al.
5,341,945 A 8/1994 Gibson
5,366,099 A * 11/1994 Schmid ..... A47F 1/126 211/59.3
5,458,248 A * 10/1995 Alain ..... A47B 96/021 211/175
5,634,564 A * 6/1997 Spamer ..... A47F 1/126 211/59.3
5,642,557 A 7/1997 Clews
5,665,304 A * 9/1997 Heinen ..... A47F 1/126 211/59.3
5,855,283 A * 1/1999 Johnson ..... A47F 1/126 211/59.3
5,865,324 A * 2/1999 Jay ..... A47F 7/28 211/74
5,873,489 A 2/1999 Ide et al.
6,047,647 A * 4/2000 Laraia, Jr. ..... A47B 57/58 211/184
D428,277 S 7/2000 White
D431,954 S 10/2000 White
6,293,405 B1 9/2001 Burch, Jr.
D450,199 S 11/2001 White
6,321,918 B1 11/2001 Rollins
6,390,310 B1 5/2002 Insalaco
6,719,152 B1 * 4/2004 Nagel ..... A47F 1/126 211/59.3
7,419,062 B2 9/2008 Mason
7,458,473 B1 * 12/2008 Mason ..... A47F 1/126 211/59.3
7,784,745 B2 8/2010 Dodge
7,850,015 B1 * 12/2010 Mason ..... A47F 1/087 211/175
7,918,353 B1 * 4/2011 Luberto ..... A47F 1/126 312/61
D694,554 S 12/2013 Yiannaki et al.
8,596,443 B2 * 12/2013 Brugmann ..... A47F 5/0093 211/172
D697,974 S 1/2014 Valls et al.
8,720,702 B2 * 5/2014 Nagel ..... A47F 1/04 211/59.3
9,038,833 B2 * 5/2015 Ciesick ..... A47F 1/04 211/59.3
9,101,230 B2 * 8/2015 Sosso ..... A47F 5/0018
9,241,583 B2 * 1/2016 Nagel ..... A47F 3/147
9,254,049 B2 * 2/2016 Nagel ..... A47F 3/0486
9,629,479 B2 * 4/2017 Sosso ..... A47F 5/0018
9,713,394 B1 * 7/2017 Bruegmann ..... A47F 5/0025
9,801,466 B2 * 10/2017 Hardy ..... A47F 5/005
9,986,852 B2 * 6/2018 Chenoweth ..... F21V 21/08
10,034,557 B1 * 7/2018 Nagel ..... A47F 5/005
10,251,494 B1 * 4/2019 Nagel ..... A47F 5/005
10,334,949 B2 7/2019 Leinonen et al.
10,334,967 B2 * 7/2019 Mercier ..... A47F 5/0093
10,912,398 B2 * 2/2021 Wills ..... A47B 57/585
10,952,548 B2 * 3/2021 Pollpeter ..... G02B 6/0095
10,959,543 B2 * 3/2021 Wills ..... A47B 57/58
11,045,017 B2 * 6/2021 Padvoiskis ..... A47F 1/00
11,166,571 B2 * 11/2021 Nagel ..... A47F 1/126
11,246,428 B2 * 2/2022 Padvoiskis ..... A47F 1/12
11,317,737 B2 * 5/2022 Berglund ..... A47F 5/0025
11,350,768 B2 * 6/2022 Nagel ..... A47B 57/58
11,517,125 B2 * 12/2022 Berglund ..... A47F 5/005
11,583,107 B2 * 2/2023 Nagel ..... A47F 5/01
12,245,706 B1 * 3/2025 Nagel ..... A47F 1/08
2002/0175132 A1 11/2002 Shea
2003/0217980 A1 * 11/2003 Johnson ..... A47F 1/126 211/59.3
2004/0000528 A1 * 1/2004 Nagel ..... A47F 1/126 211/59.3
2004/0079715 A1 * 4/2004 Richter ..... A47F 1/126 211/59.3
2005/0092702 A1 * 5/2005 Nagel ..... G09F 3/204 211/59.3
2005/0166806 A1 * 8/2005 Hardy ..... A47F 1/126 108/61
2006/0032827 A1 * 2/2006 Phoy ..... A47F 1/12 211/74
2006/0186064 A1 * 8/2006 Merit ..... A47F 5/005 211/59.3
2006/0186065 A1 * 8/2006 Ciesick ..... A47F 1/04 211/59.3
2007/0080126 A1 4/2007 Music
2007/0138114 A1 * 6/2007 Dumontet ..... A47F 1/126 211/59.3
2007/0170127 A1 * 7/2007 Johnson ..... A47F 1/126 211/59.3
2007/0175839 A1 * 8/2007 Schneider ..... A47F 1/126 211/59.3
2008/0142458 A1 6/2008 Medcalf
2008/0156752 A1 * 7/2008 Bryson ..... A47F 1/126 211/59.3
2010/0025346 A1 * 2/2010 Crawbuck ..... A47F 1/12 211/59.3
2010/0032391 A1 2/2010 Schneider et al.
2010/0107670 A1 * 5/2010 Kottke ..... A47F 5/0838 62/250
2010/0108624 A1 * 5/2010 Sparkowski ..... A47F 1/126 211/59.3
2010/0140197 A1 6/2010 Schneider et al.
2010/0176077 A1 * 7/2010 Nagel ..... A47F 1/125 211/126.16
2010/0307992 A1 12/2010 Robertson et al.
2011/0017684 A1 * 1/2011 Nagel ..... A47F 1/126 211/59.3
2011/0290749 A1 * 12/2011 Neumann ..... A47F 5/0838 248/241
2012/0031865 A1 2/2012 Paeth
2012/0211450 A1 * 8/2012 Kologe ..... A47F 5/0025 211/59.3
2013/0020270 A1 1/2013 Valiulis et al.
2013/0112634 A1 * 5/2013 Nagel ..... A47F 5/08 211/59.3
2013/0193095 A1 * 8/2013 Nagel ..... A47F 5/0861 211/59.3
2013/0199066 A1 8/2013 Clark et al.
2014/0117179 A1 5/2014 Valls et al.
2014/0151313 A1 6/2014 Breslow et al.
2014/0167962 A1 * 6/2014 Valiulis ..... G07F 9/026 211/59.3
2014/0190914 A1 7/2014 Nagel
2014/0305889 A1 * 10/2014 Vogler ..... A47F 5/0846 211/59.3
2014/0305890 A1 10/2014 Vogler et al.
2014/0319086 A1 * 10/2014 Sosso ..... A47F 5/0018 211/59.3
2014/0319088 A1 10/2014 Neumann et al.
2015/0021283 A1 * 1/2015 Bruegmann ..... A47F 1/12 211/59.2
2015/0068991 A1 * 3/2015 Kostka ..... A47F 1/126 211/59.3
2015/0129520 A1 * 5/2015 Kologe ..... A47F 1/126 211/59.3
2015/0157142 A1 6/2015 Turner et al.
2015/0208830 A1 * 7/2015 Hardy ..... A47B 57/58 211/59.3
2015/0230628 A1 * 8/2015 Juric ..... A47F 5/005 211/59.4
2015/0257547 A1 * 9/2015 Nagel ..... A47F 3/147 211/59.3
2016/0150894 A1 6/2016 Howard et al.
2017/0007038 A1 * 1/2017 Ewing ..... A47F 1/126
2017/0172314 A1 6/2017 Vogler et al.
2017/0196355 A1 * 7/2017 Hardy ..... A47F 1/126
2017/0215602 A1 * 8/2017 Bruegmann ..... A47F 1/125

(56) References Cited

U.S. PATENT DOCUMENTS

| | | | | |
|---|---|---|---|---|
| 2017/0224131 | A1* | 8/2017 | Murphy | A47F 3/002 |
| 2017/0318985 | A1 | 11/2017 | Collette | |
| 2018/0310725 | A1 | 11/2018 | Pena et al. | |
| 2020/0093282 | A1 | 3/2020 | Bruegmann | |
| 2020/0196775 | A1 | 6/2020 | Berglund et al. | |
| 2021/0052087 | A1* | 2/2021 | Nagel | A47F 5/005 |
| 2021/0059434 | A1* | 3/2021 | Ciesick | A47F 5/0043 |
| 2022/0039564 | A1 | 2/2022 | Nagel | |

* cited by examiner

PULL-OUT TRAY FOR SHELVING

CROSS-REFERENCE TO RELATED PATENT APPLICATIONS

This patent application is a continuation of co-pending U.S. patent application Ser. No. 18/466,518, filed Sep. 13, 2023, the entire teachings and disclosure of which are incorporated herein by reference thereto.

FIELD OF THE INVENTION

This invention generally relates to retail merchandise displays, and more particularly to self-facing retail merchandise displays used for biasing retail merchandise forward.

BACKGROUND OF THE INVENTION

Self-facing retail merchandise displays are generally known in the art. Once such merchandise display is the pusher system. A conventional pusher system incorporates one or more pusher paddles or pusher bodies that ride along a respective elongated track. A spring is connected between the pusher body and a leading edge of the track. The spring acts to bias the pusher body forward along the track towards the leading edge thereof.

A user can retract the pusher body away from the leading edge of the track and position one or more items of retail merchandise in a linear row on top of the track and between the leading edge of the track and the pusher body. The biasing force provided by the spring and exerted upon the pusher body serves to bias the linear row of retail merchandise forward to ultimately "front face" the merchandise.

Therefore, when a customer removes the first or most front-facing item of merchandise from the linear row of merchandise, the pusher body will be drawn forward by the spring to index the row of merchandise forward so that the next item of merchandise in the row is positioned proximate the leading edge of the track in an aesthetically pleasing manner. Such automatic front-facing movement of the merchandise eliminates the need for retail store employees to manually face or position the merchandise, and thus ultimately reduces the cost of labor of the retailer.

The aforementioned pusher systems have been utilized in various retail display environments. One such retail display environment is a retail shelf. Typically, a plurality of pusher bodies and their corresponding tracks are arranged in a side-by-side manner along the shelf. Each pusher body and its corresponding track are separated by dividers to maintain a plurality of generally straight rows of merchandise that run from the front to the back of the shelf. Such a familiar configuration can be found in many retail stores for selling hygiene items such as deodorant, as one example.

In another configuration, the pusher system may be embodied as a stand-alone pusher tray. These trays may include means for mounting the tray as a cantilevered extension from another structure, such as a bar. These trays may also be situated directly on a retail shelf. Further, these trays may include side barriers which are adjustable so as to accommodate merchandise of differing widths. Examples of these trays may be readily seen at U.S. Pat. Nos. 9,254,049, 9,241,583, and 8,720,702, each of which is incorporated by reference herein in its entirety.

Embodiments of the invention relate to improvements in the above-described pusher systems, more particularly, the above-described pusher trays. These and other advantages of the invention, as well as additional inventive features, will be apparent from the description of the invention provided herein.

BRIEF SUMMARY OF THE INVENTION

In one aspect, embodiments of the invention provide a retail merchandise tray system includes a pusher tray which includes a pusher tray. The pusher tray includes a pair of opposed load bearing members, a front stop mounted to the pair of load bearing members, and a wire support frame supported at least in part by the pair of load bearing members. The pusher tray further includes a pusher mounted to the wire support frame. The pusher is movable along the wire support frame toward and away from the front stop along a first axis. The retail merchandise tray system further includes a base configured for removable attachment to the pusher tray. The base is further configured for attachment to a retail shelf. The attachment of the pusher tray to the base is such that the pusher tray is configured to slide back and forth between a loading configuration and a dispensing configuration.

In a particular embodiment, the wire support frame has opposed first and second ends, the wire support frame being removably attached at the first end to the front stop, and removably attached at the second end to the pair of load bearing members. In some embodiments, the pusher tray includes a carriage slide for attaching the pusher tray to the base, the carriage slide having at least one flange element. In other embodiments, the base includes two parallel base plates that extend along a length of the base, the base plates spaced apart such that a slot extends along a length of the base plates. The at least one flange element may be configured for insertion into the slot for attaching the pusher tray to the base. In a more particular embodiment, the at least one flange element has a neck portion which is narrower than the slot, and a flange plate which is wider than the slot, and following the insertion into the slot, the neck portion is within the slot, the flange plate is below the slot, and the pusher tray is above the slot.

In certain embodiments, the base plates are attached to a base front member at one end, and attached to a base rear member at another end opposite the one end. The retail merchandise tray system may also include a front spacer and rear spacer, each spacer aligned along the first axis and interposed between the pair of load bearing members, and wherein each spacer includes a pair of parallel cylindrical members. In some embodiments, the carriage slide includes a pair of resilient clips configured for attachment to the pair of parallel cylindrical members. The carriage slide may further include a pair of projections that extend laterally from one of the parallel cylindrical members. In a particular embodiment, the pair of projections extend below a lateral member attached to the wire support frame. In certain embodiments, the front and rear spacers are situated below the wire support frame.

In a further embodiment, the carriage slide includes two flange elements spaced apart along a central portion of the carriage slide. The retail merchandise tray system may also include a front spacer and rear spacer, each aligned along the first axis and interposed between the pair of load bearing members, where each spacer includes a pair of parallel cylindrical members.

In a particular embodiment, the retail merchandise tray system has a tray catch attached to the base. The base may have two parallel base plates that extend along a length of the base, and the base plates may be spaced apart such that a slot extends along a length of the base plates. In some embodiments, the tray catch is attached to the base plates. The tray catch may include a front stop clip and a rear stop clip, each configured for attachment to one of the pair of parallel cylindrical members. In certain embodiments, the front stop clip faces the front stop, and is assembled to the front spacer when the pusher tray is in the dispensing configuration. Furthermore, the rear stop clip may face a direction opposite that of the front stop clip, and may be assembled to the rear spacer when the pusher tray is in the loading configuration.

In a further embodiment, the retail merchandise tray system has a mounting rail configured for mounting to the retail shelf and at least one mounting tab, the mounting rail including a plurality of spaced apart teeth arranged to receive the at least one mounting tab in a space between adjacent teeth. The mounting rail may be attached to a front end of the base or, in alternate embodiments, attached to a rear end of the base.

In certain embodiments, the retail merchandise tray system includes at least one divider assembly movable relative to the pair of opposed load bearing members along a second axis perpendicular to the first axis. The at least one divider assembly may include a pair of divider assemblies movable about the second axis and arranged such that the pair of load bearing members are interposed between the pair of divider assemblies. Further, the at least one divider assembly may have a divider wall and a pair of wire supports, where the pair of wire supports is removably attached to the divider by a resilient connection. Additionally, the divider wall may include an upright portion having opposed sides, wherein a flange extends from at least one of the opposed sides perpendicular to the upright portion.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

In FIGS. 1-14, various views and perspectives of a pusher device 100, an attached base 228, and components thereof are illustrated. A pusher device (also referred to as a "pusher tray") according to the teachings herein as the advantage of having a reduced assembly time and cost due in part to the weld-free interconnection of its various components. Still further, the pusher tray 100, according to the teachings herein, presents a new and improved shelf mounting configuration for those trays which mount directly to a retail shelf 312. These and other advantages will be understood from the following detailed description.

Figure 1:
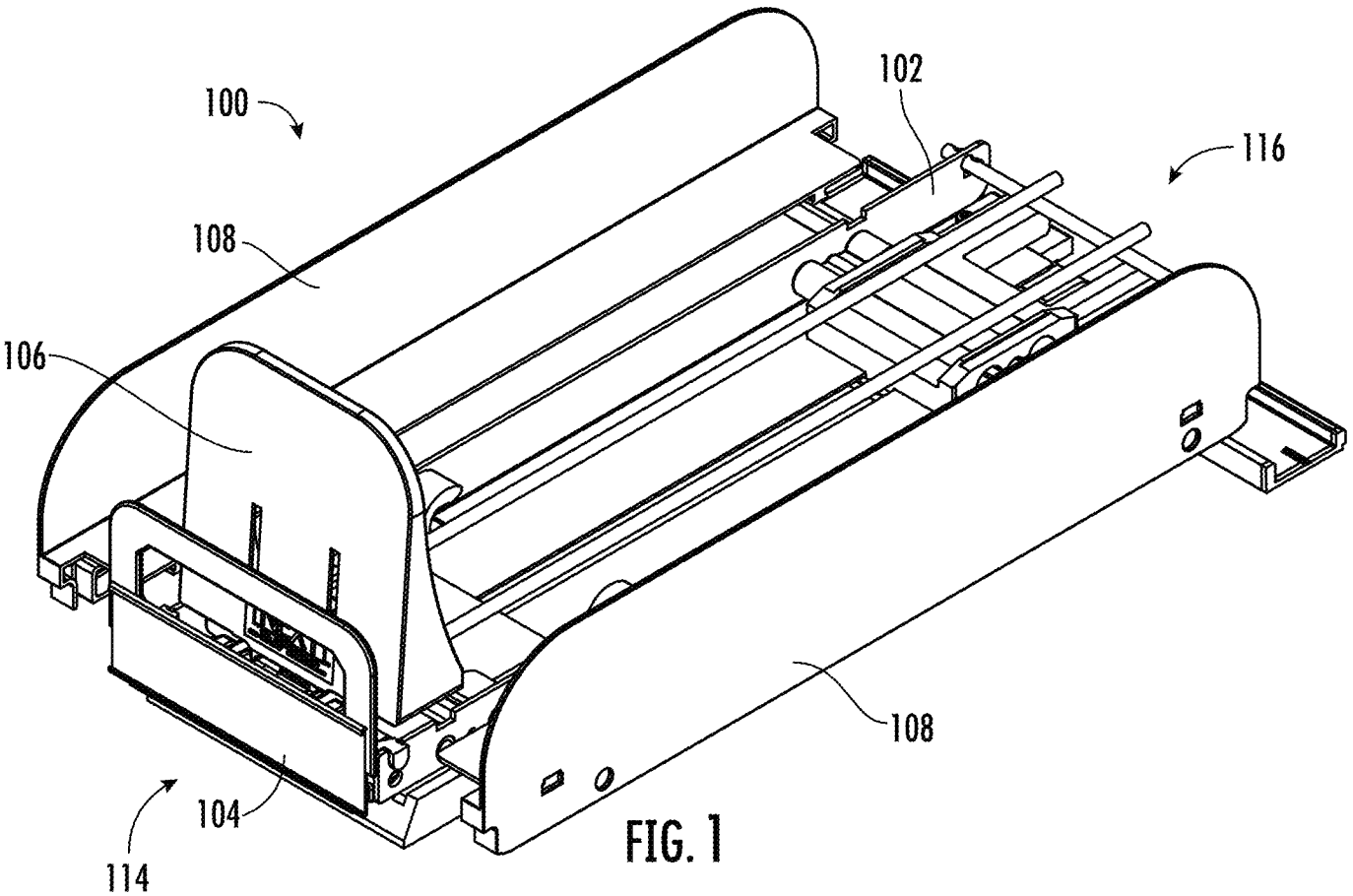
FIG. 1 is a perspective view of an exemplary retail merchandise tray system with a pusher tray and a base shown in a dispensing configuration, and constructed in accordance with an embodiment of the invention.
Figure 2:
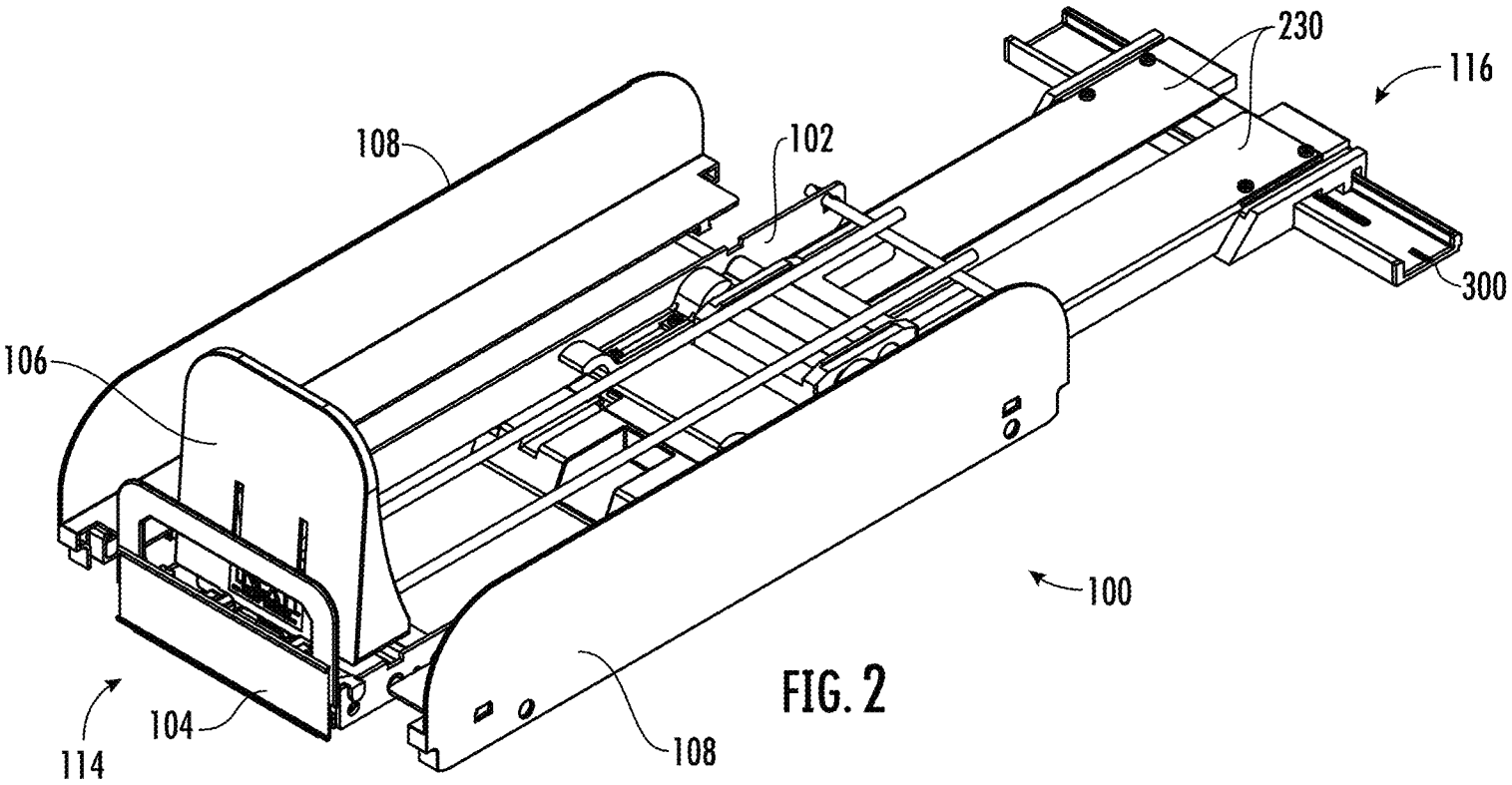
FIG. 2 is a perspective view of an exemplary retail merchandise tray system with a pusher tray and a base shown in a loading configuration, and constructed in accordance with an embodiment of the invention.

FIG. 1 is a perspective view of an exemplary retail merchandise tray system with a pusher tray 100 and a base 228 (see FIG. 11) shown in a dispensing configuration, and constructed in accordance with an embodiment of the invention, while FIG. 2 is a perspective view of an exemplary retail merchandise tray system with a pusher tray 100 and a base 228 shown in a loading configuration, according to an embodiment of the invention. In FIGS. 1 and 2, the pusher tray 100 has a pair of load bearing members 102. In some embodiments, the load bearing members 102 are identical so a description of one applies equally well to the other. A front stop 104 is connected to the load bearing members 102 at a first end 114 of tray 100. Front stop 104 may include additional integrated or attached structures such as price channel extrusions, faceplates, etc. A first axis runs along a length of the pusher tray 100 and base 228 (see FIG. 11) parallel to the load bearing members 102. A second axis is perpendicular to the first axis extending laterally and parallel to mounting rail 300.

As shown in FIG. 2, pusher tray 100 has a second position (i.e., the loading configuration) wherein the tray 100 has a second longitudinal length which is longer than the first longitudinal length. In this position, the load bearing members 102 (and indeed the remainder of pusher tray 100) have slidably moved relative to the base 228. This sliding or pullout functionality advantageously allows pusher tray 100 to slide forward when it is time to reload tray 100. This is particularly helpful where the pusher tray 100 is mounted in a rack system with other shelving or other trays above and below it. In such an instance, access to the pusher tray 100 for reloading is generally limited and difficult due to the obstruction above the tray 100 by other shelving or trays. As such, being able to draw the pusher tray 100 forward to expose a substantial amount if not the entirety of the wire support frame 110 allows for rapid reloading of the pusher tray 100.

A pusher panel 106 is mounted to a wire support frame 110 and slidable thereon from the first end 114 to a second end 116. The pusher panel 106 is operable to bias a row or rows of retail merchandise situated on top of the wire support frame 110 and load bearing members 102 from the second end 116 of pusher tray 100 toward the first end 114 of pusher tray 100. As may be seen from FIG. 1, the pusher panel 106 may be a solid member or may have cutouts, for example a honeycomb structure, to reduce the weight of the pusher panel 106. As will be explained below, pusher panel 106 is typically biased under the force of a coil spring or other biasing element.

Figure 3:
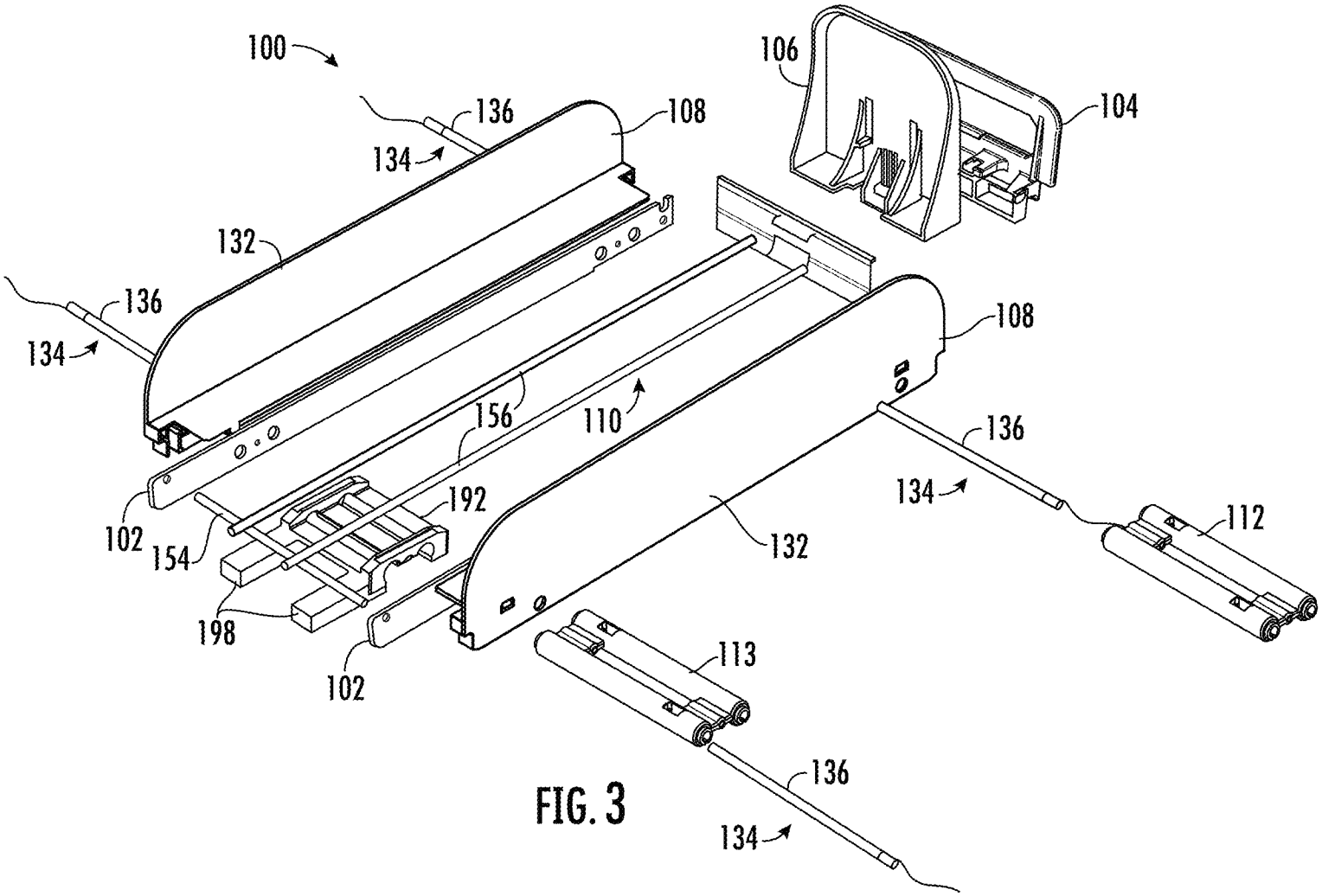
FIG. 3 is an exploded perspective view of the pusher tray shown in FIGS. 1 and 2, according to an embodiment of the invention.

FIG. 3 is an exploded perspective view of the pusher tray 100 shown in FIGS. 1 and 2, according to an embodiment of the invention. As shown in FIG. 3, the wire support frame 110 is removably attached to the front stop 104 adjacent the first end 114, and removably attached to the load bearing members 102 adjacent the second end 116 of the pusher tray 100. As shown in this embodiment, the wire support frame 110 has opposed first and second ends which are adjacent the first and second ends 114, 116 of pusher tray 100, respectively.

As shown in FIG. 3, the wire support frame 110 includes a lateral member 154 and a pair of longitudinal members 156 extending generally perpendicular to lateral member 154. As its name implies, wire support frame 110 is typically formed of metal wire though other materials may be used for this part. The wire support frame 110 has longitudinal members 156 welded to lateral member 154 in some embodiments. Although two longitudinal elements 156 are illustrated, fewer or greater longitudinal members 156 may be employed depending on the overall width of pusher tray 100.

In the embodiments shown, a pair of movable divider assemblies 108 are positioned on either side of tray 100. It should also be noted that although two divider assemblies 108 are shown, only a single divider assembly 108 may be employed in some alternate configurations, while in other alternate configurations, the divider assemblies 108 may be omitted entirely.

Referring again to FIG. 3, the pusher tray 100 also includes a pair of spacers 112, 113 which are used on the one hand to maintain the lateral spacing between load bearing members 102, and on the other hand to receive wire supports of divider assemblies 108 as discussed below. More specifically, FIG. 3 shows that the pusher tray 100 includes a front spacer 112 and a rear spacer 113. In some embodiments, front and rear spacers 112, 113 attach to load bearing members 102 via fasteners or any other mechanical expedient.

As indicated above, and with particular reference to FIGS. 1 and 2, the pusher panel 106 is slidably mounted to wire support frame 110. In the embodiment shown, the front stop 104 is disposed at a front end of the tray, and pusher panel 106 is movable toward and away from the front stop 104 via a biasing element such as coil spring 180 (shown in FIG. 6). The load bearing members 102 provide structural support to the pusher tray 100 and also provide mounting locations for the spacers 112, 113 as well as wire support frame 110.

Figure 4:
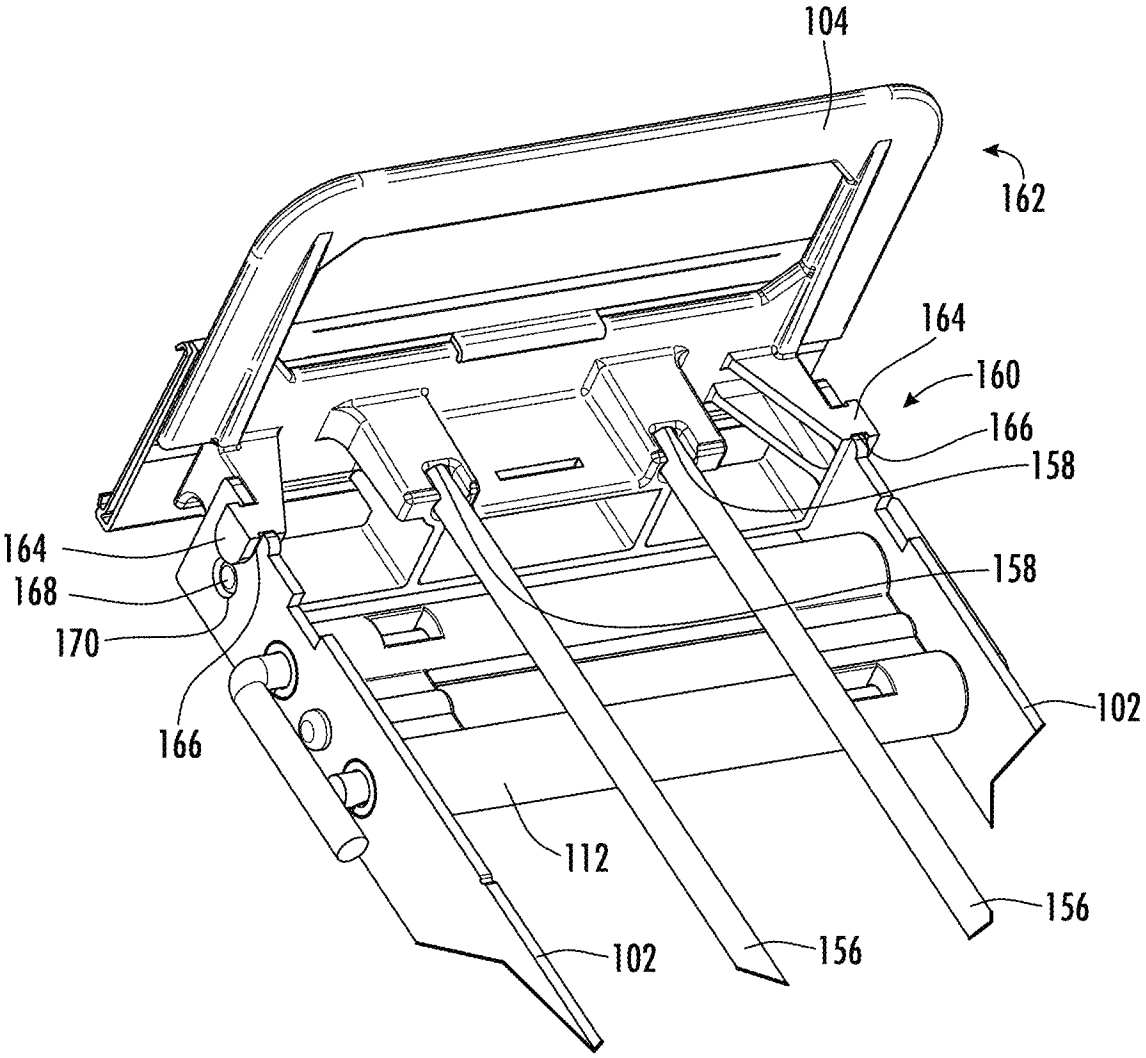
FIG. 4 is a partial perspective of the pusher tray of FIG. 1, illustrating a front stop thereof, in accordance with an embodiment of the invention.

FIG. 4 is a partial perspective of the retail merchandise tray system of FIG. 1, illustrating the front stop 104 thereof, in accordance with an embodiment of the invention. In FIG. 4, front stop 104 mounts to load bearing members 102 as shown. In particular, front stop 104 includes a mounting portion 160 which extends generally perpendicular to an upright portion 162 as shown. This mounting portion includes laterally extending tabs 164 which are received in corresponding open slots 166 formed in load bearing members 102. These tabs 164 and their corresponding slots 166 are U-shaped such that they cannot rotate relative to one another. This has the advantage of preventing unwanted rotation of front stop 104 relative to load bearing members 102. Additionally, mounting portion 160 may also include protrusions 168 received in corresponding apertures 170 for the same purpose.

Mounting portion 160 also includes pockets 158 within which the terminal ends of longitudinal members 156 are received and supported from an underside thereof. As such, wire support frame 110 is supported at either end, as introduced above.

Figure 5:
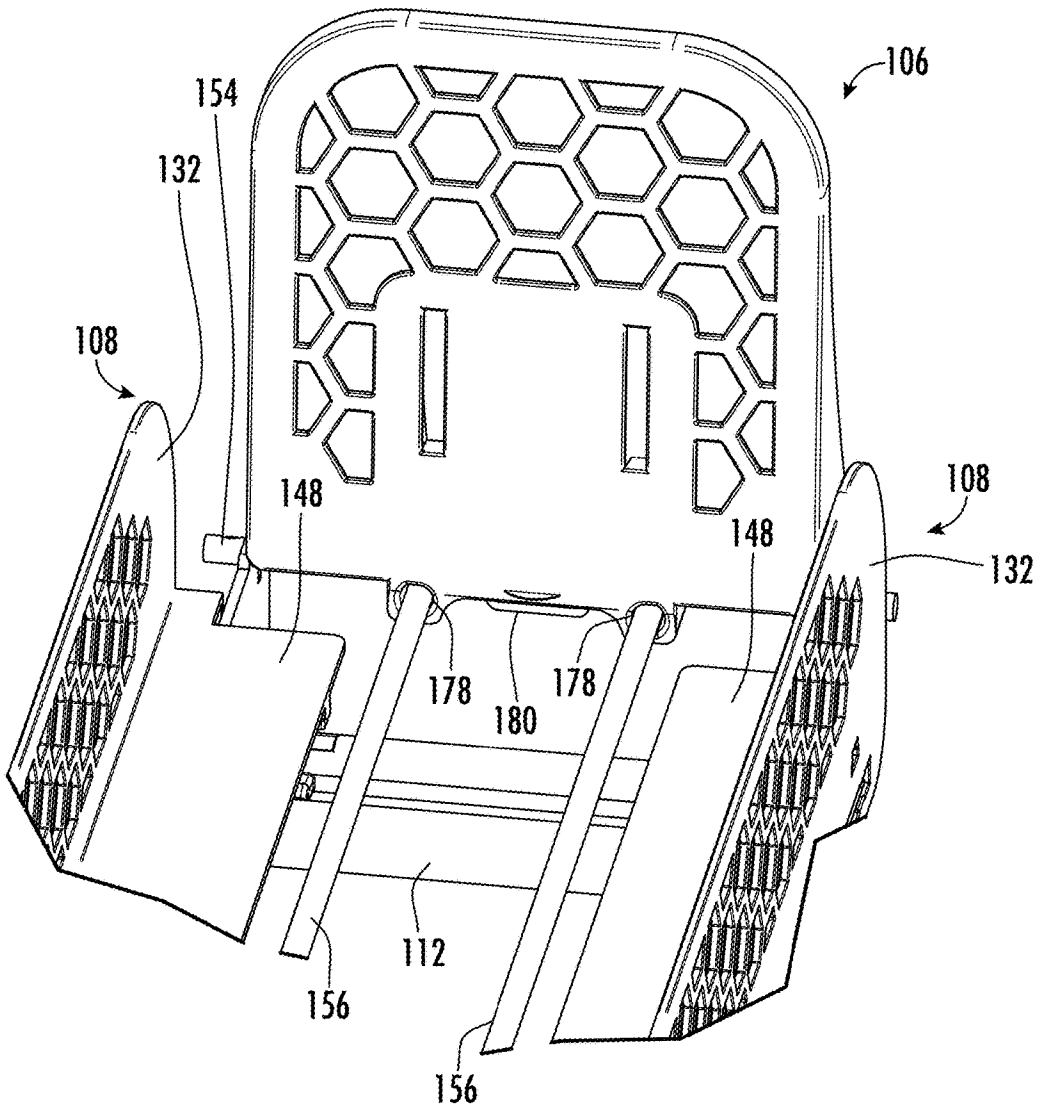
FIG. 5 is a partial perspective view of the pusher tray of FIG. 1, illustrating a pusher thereof, in accordance with an embodiment of the invention.

FIG. 5 is a partial perspective view of the retail merchandise tray system of FIG. 1, illustrating a pusher 106 thereof, in accordance with an embodiment of the invention. In FIG. 5, the pusher 106 is shown on as slidable on wire support frame 110. To this end, pusher 106 includes wire receiving passageways 178 through which longitudinal members 156 extend. As may be surmised from inspection of FIG. 5, pusher 106 is fully supported by the wire support frame 110. This results in minimal contact of pusher 106 with the remainder of tray 100, thereby reducing or eliminating the likelihood of binding or the like.

Figure 6:
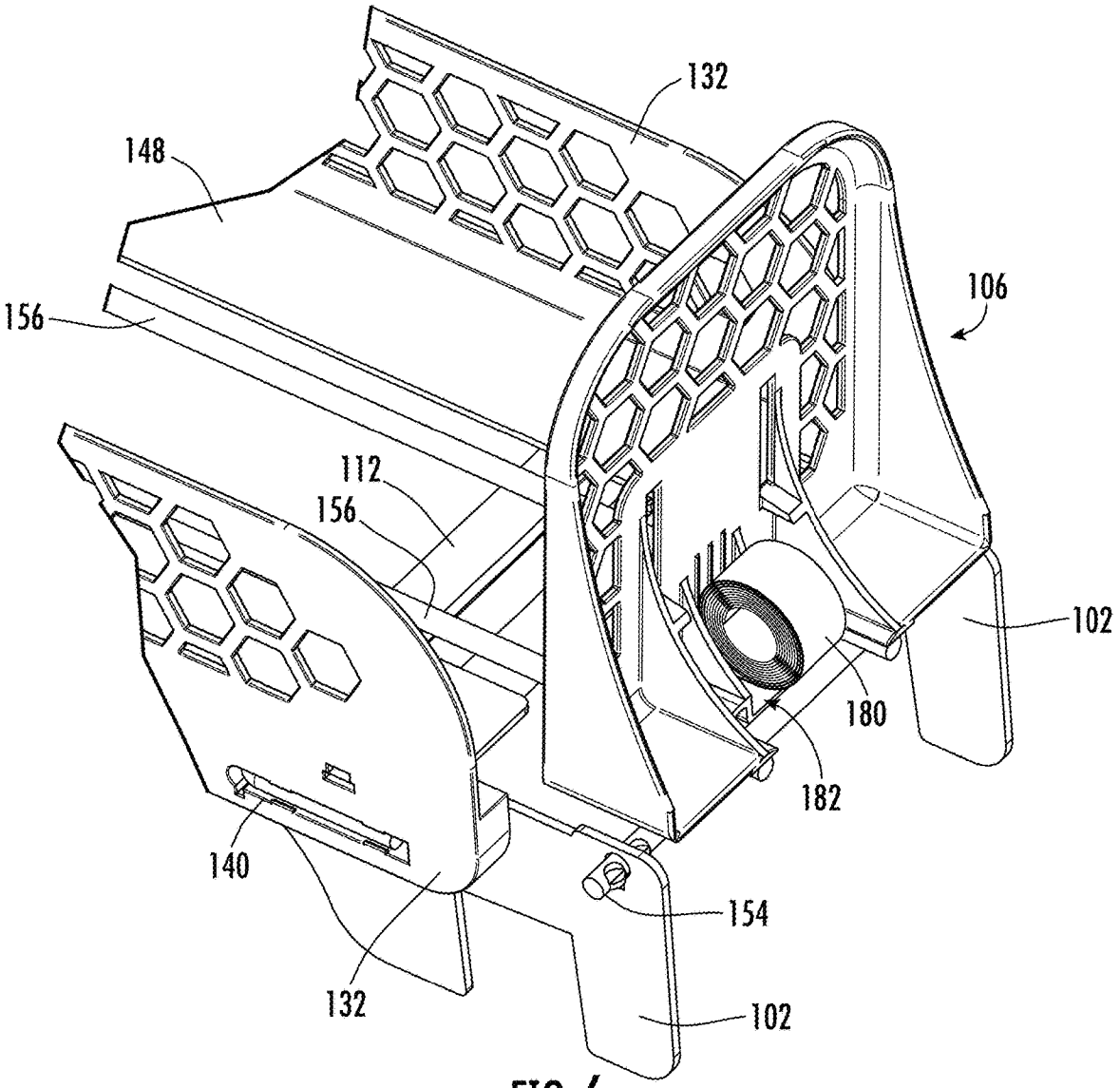
FIG. 6 is different perspective view showing a rear side of the pusher shown in FIG. 5, in accordance with an embodiment of the invention.

FIG. 6 is different perspective view showing a rear side of the pusher 106 shown in FIG. 5, in accordance with an embodiment of the invention. A spring opening 182 is also formed through pusher 106 for feeding an uncoiled portion of a coil spring 180, as shown in FIG. 6. This coil spring 180 rests on pusher 106 and its free end passes through opening 180 and connects to front stop 104, or any other portion of tray 100 sufficient to apply a biasing force to pusher 106 to pull it from second end 116 to first end 114 shown in FIG. 1.

Figure 7:
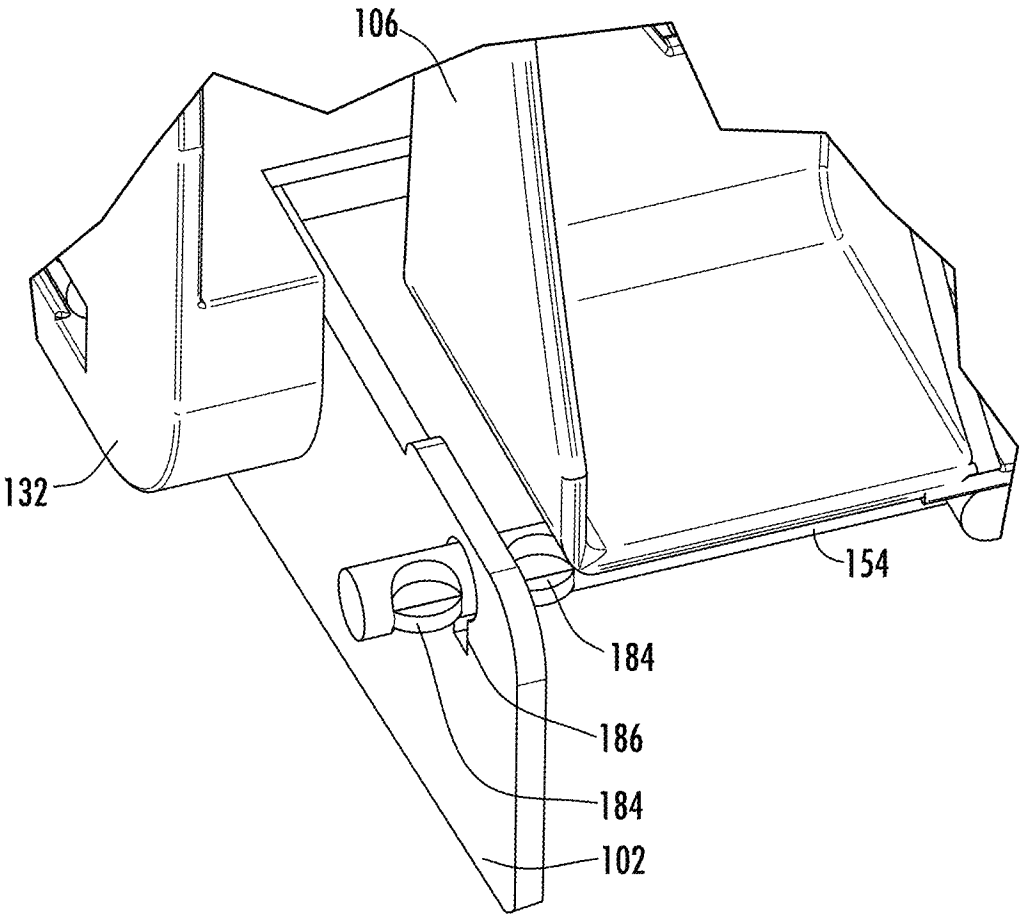
FIG. 7 is a partial perspective view of the pusher tray of FIG. 1, illustrating a removable connection between a wire support frame and a load bearing member of the pusher tray, according to an embodiment of the invention.

FIG. 7 is a partial perspective view of the retail merchandise tray system of FIG. 1, illustrating a removable connection between a wire support frame 110 and a load bearing member 102 of the pusher tray 100, according to an embodiment of the invention. In FIG. 7, lateral member 154 includes keys 184 adjacent the ends of lateral member 154. One end of lateral member 154 and its respective keys 184 are shown in FIG. 7. An identical configuration exists for the other end. These keys are formed and sized such that they may pass through a keyway 186 formed in load bearing members 102.

As shown in the illustrated view, the outer most key 184 has passed through keyway 186 to thereby interpose load bearing member 102 between keys 184. This configuration maintains the lateral positioning of wire support frame 110 relative to load bearing members 102. It is also possible to omit the inner keys 184 at each end of lateral member 154 and use only the outer most keys 184, such that the load bearing 102 are interposed between these outer most keys 184.

Figure 8:
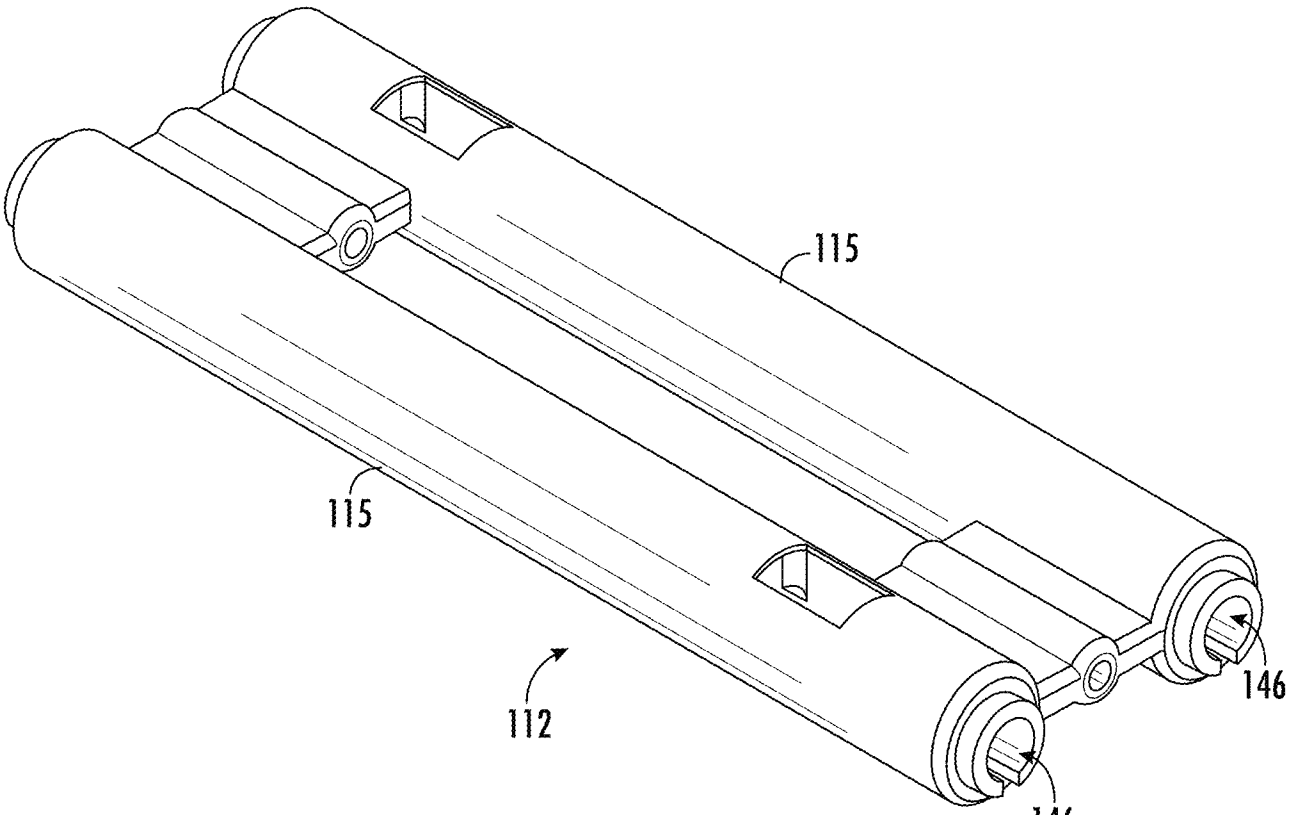
FIG. 8 is a perspective view of the front or rear spacer, in accordance with an embodiment of the invention.
Figure 9:
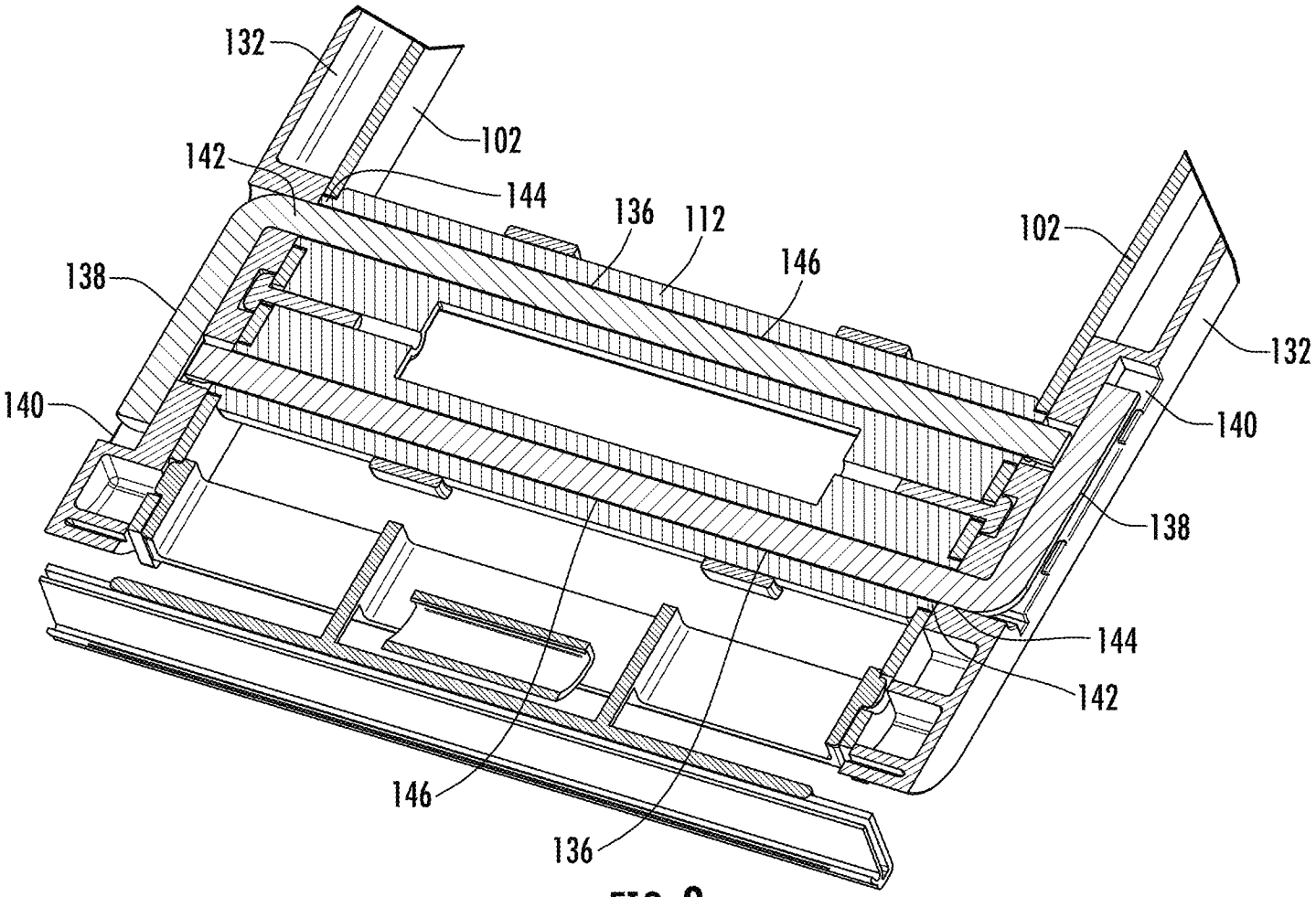
FIG. 9 is a cross-sectional view of the pusher tray of FIG. 1, taken in the region of a spacer, in accordance with an embodiment of the invention.

FIG. 8 is a perspective view of the front or rear spacer 112, 113, in accordance with an embodiment of the invention, while FIG. 9 is a cross-sectional view of the pusher tray 100 of FIG. 1, taken in the region of the spacer 112, 113, according to an embodiment of the invention. In some embodiments, front and rear spacers 112, 113 are identical so a description of one applies equally well to the other. These spacers 112, 113 may formed of a lightweight material such as plastic or the like, and attach at their side edges to load bearing members 102 such that the spacers 112, 113 are interposed between load bearing members 102. More specifically, in the illustrated embodiment, each spacer 112, 113 has a pair of parallel cylindrical members 115 that extend between the pair of load bearing members 102. The cylindrical members 115 are parallel but spaced apart, being connected by a relatively flat portion of the spacer 112, 113. Further, each cylindrical member 115 has a passage that extends the full length of the cylindrical member 115.

As illustrated in FIG. 3, the divider assemblies 108 may be adjustable to modify a width or distance between the divider assemblies 108, and move in directions perpendicular to the direction in which the load bearing members 102. This lateral adjustment allows for the accommodating retail merchandise of differing widths. As will be explained below, each divider assembly 108 includes a divider wall 132 and a pair of wire supports 134 which are removably attached to divider wall 132. In the embodiment shown, the wire supports 134 are configured to pass through a pair of cylindrical openings in the spacers 112, 113. Specifically, the wire supports 134 are configured to pass through the aforementioned passage in the pair of parallel cylindrical members 115. In particular embodiments, each wire support 134 connects to divider wall 132 with a resilient "snap" style connection to thereby hold it in place during operation. As a result, lightweight materials may be utilized for the divider walls 132 themselves, while more robust materials may be utilized for the wire supports.

With reference now to FIG. 9, the same illustrates a cross section through the front spacer 112 shown in FIG. 2. Each of the spacers 112, 113 has a pair of passageways 146 which overlap one another as shown. The pair of parallel cylindrical members 115 are shown with respective passageways 146. These passageways 146 align with passageways or openings 142 formed in each of the load bearing members 102 and aligned with openings in each of the divider walls 132. This alignment allows for the straight portion 136 of each wire support 134 disposed within passageways 146 of parallel cylindrical members 115 to pass through the openings 142 in the load bearing members 102, and then into the openings of each divider wall 132. In an exemplary embodiment, each of the two spacers 112, 113 has a first wire support 134 in one of the two parallel cylindrical members 115 such that the wire support 134 extends laterally in a first direction, and a second wire support 134 in the other of the two parallel cylindrical members 115 where the wire support 134 extends laterally in a second direction opposite the first direction. This allows for adjusting the location of the divider walls 132 by sliding the various wire supports 134 into or out of the passageways 146.

In certain embodiments of the invention, the divider wall 132 includes a flange 148 depending perpendicular to the divider wall's generally upright presentation. This flange 148 may be utilized to support merchandise extending laterally beyond load bearing members 102. In certain embodiments, each wire support 134 includes a straight portion 136 with an end configured to insert and attach to an opening, for example a circular opening in the divider wall. In alternate embodiments, the wire support 134 also includes a bent portion 138 generally at a right angle to straight portion 136. Bent portions 138 are received in corresponding apertures 140 formed in divider wall 132. Each aperture 140 has a passage formed therein for receipt of straight portion 136 such that straight portion 136 passes through divider wall 132 until bent portion 138 bottoms out in aperture 140. This configuration allows for divider assembly 108 to be of a multi-material construction, with wire supports 134 formed of a rigid material such as metal, while divider wall 132 may be formed of a lightweight material such as plastic for example. Further, as was the case with pusher panel 106, divider wall 132 may be a solid panel or include cutout portions to reduce its overall weight.

In particular embodiments, the load bearing members 102 have generally flat bottoms so that they may sit directly on a shelf. The pusher tray 100 may also incorporate a shelf mounting arrangement for fixing the pusher tray 100 on to a retail shelf. An example of a device, used to facilitate such a shelf mounting arrangement, may be in the form of a carriage slide 192 (shown in FIG. 10) which snaps onto the front spacer 112 of pusher tray 100.

Figure 10:
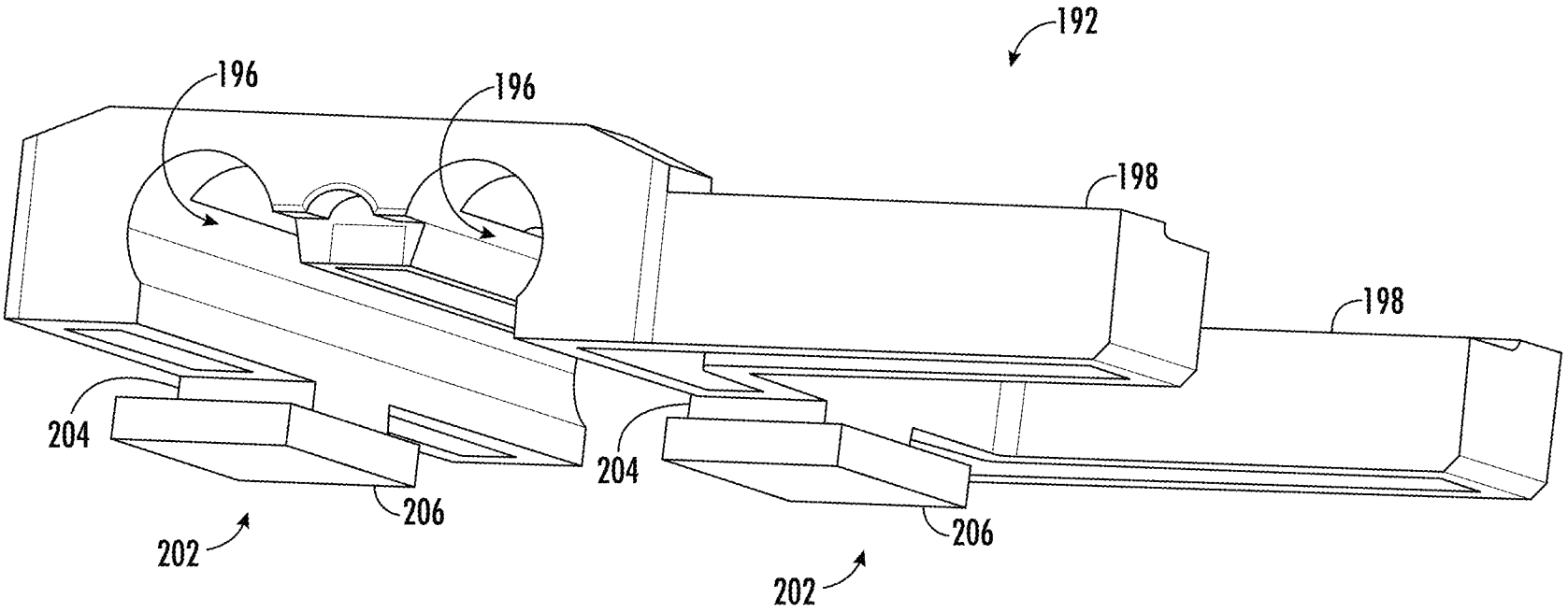
FIG. 10 is a perspective view of a carriage slide, in accordance with an embodiment of the invention.
Figure 11:
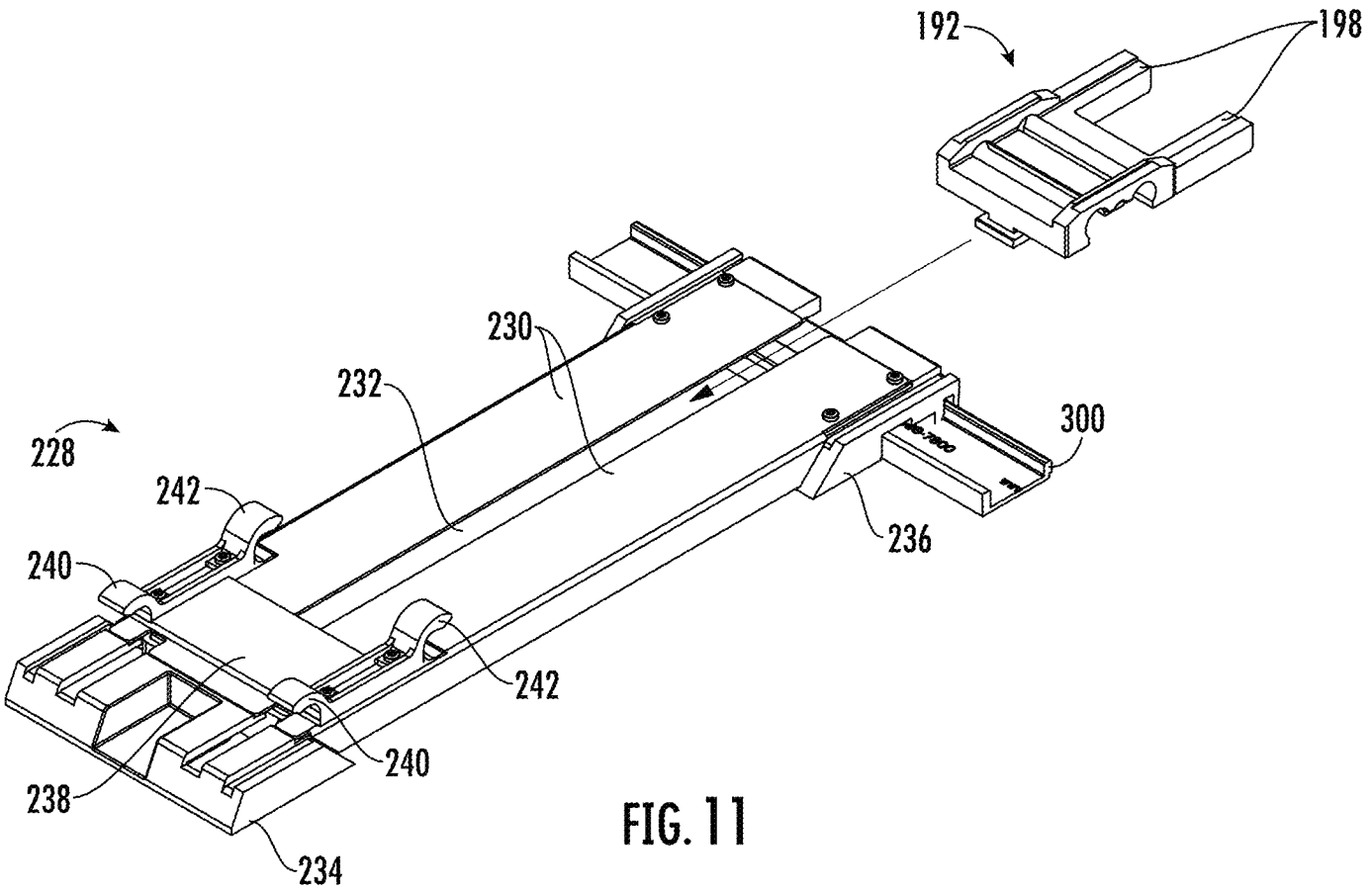
FIG. 11 is a perspective view of the base, constructed in accordance with an embodiment of the invention.

FIG. 10 is a perspective view of the carriage slide 192, also shown in FIG. 11, in accordance with an embodiment of the invention. In the embodiment shown, the carriage slide 192 includes a pair of clips 196 configured to be attached along a top surface of the rear spacer 113. Each of the clips 196 is made to be resilient such that each of the clips 196 flexes to open wider when removably attaching to one of the parallel cylindrical members 115 of rear spacer 113 (see FIGS. 1 and 2). The resilient clips 196 then return to their original shape when closing around the cylindrical members 115. In the embodiment shown, the clips 196 are slightly more than semi-circular to allow for retention of the parallel cylindrical members 115. The two clips 196 are also parallel such that they align with the parallel cylindrical members 115 of rear spacer 113, such that the clips 196 attach to both parallel cylindrical members 115 at the same time.

Two lateral projections 198 extending transversely (and rearward) from the rear-most clip 196. In the embodiment shown, these lateral projections 198 extend below lateral member 154. In this way, the lateral member 154 blocks any upward movement of the carriage slide 192, and serves to keep the carriage slide 192 fastened to the rear spacer 113. On a bottom side of the carriage slide 192, there are two downward-depending flange elements 202. In the embodiment shown, the downward-depending flange elements 202 are positioned centrally on the carriage slide 192, approximately midway between the load bearing members 102.

Referring again to FIG. 10, each of the downward-depending flange elements 202 includes a neck portion 204 having one end connected to the bottom surface of the carriage slide 192. The neck portion 204 depends downward from the carriage slide 192 and the other end of the neck portion 204 is attached to a flange plate 206. In the embodiment shown, the neck portion is attached at a center of the flange plate 206, and the flange plate 206 is square though, in alternate embodiments, the flange plate 206 may be shaped differently (e.g., circular, rectangular, oval, etc.). The neck portion 204 is relatively narrow in comparison to the width of the flange plate 206.

FIG. 11 is a perspective view of the base, constructed in accordance with an embodiment of the invention. The pusher tray 100 is configured to attach to a base 228, which is design to slidably attach to a retail shelf. Base 228 includes two base plates 230 that extend longitudinally along a length of the base 228. The base plates 230 are spaced apart in parallel such that a slot 232 is defined between the base plates 230, where the slot 232 extends longitudinally along the length of the base plates 230. At a front end, the two base plates 230 attach to a base front member 234. At a rear end, the two base plates 230 attach to a base rear member 236. In this instance, the front end of the base 228 corresponds to first end 114 referenced above, and a rear end of the base 228 corresponds to second end base front member 236 defines a second end of the slot 232 opposite the first end.

When the pusher tray 100 is attached to the base 228, the relatively narrow neck portion 204 is narrower than slot 232, and configured to slide into the slot 232 at the second (rear) end 116 such that the bottom surface of the carriage slide 192 is above the two base plates 230, while the flange plate 206 is below the two base plates 230. At the first (front) end 114, the slot 232 is closed by the tray catch 238. Because the flange plate 206 is wider than the neck portion 204 and wider than the slot 232, the carriage slide 192, and consequently the pusher tray 100, cannot be removed from the base 228 other than by sliding the neck portion 204 out of the slot 232 at the first end 114.

Figure 12:
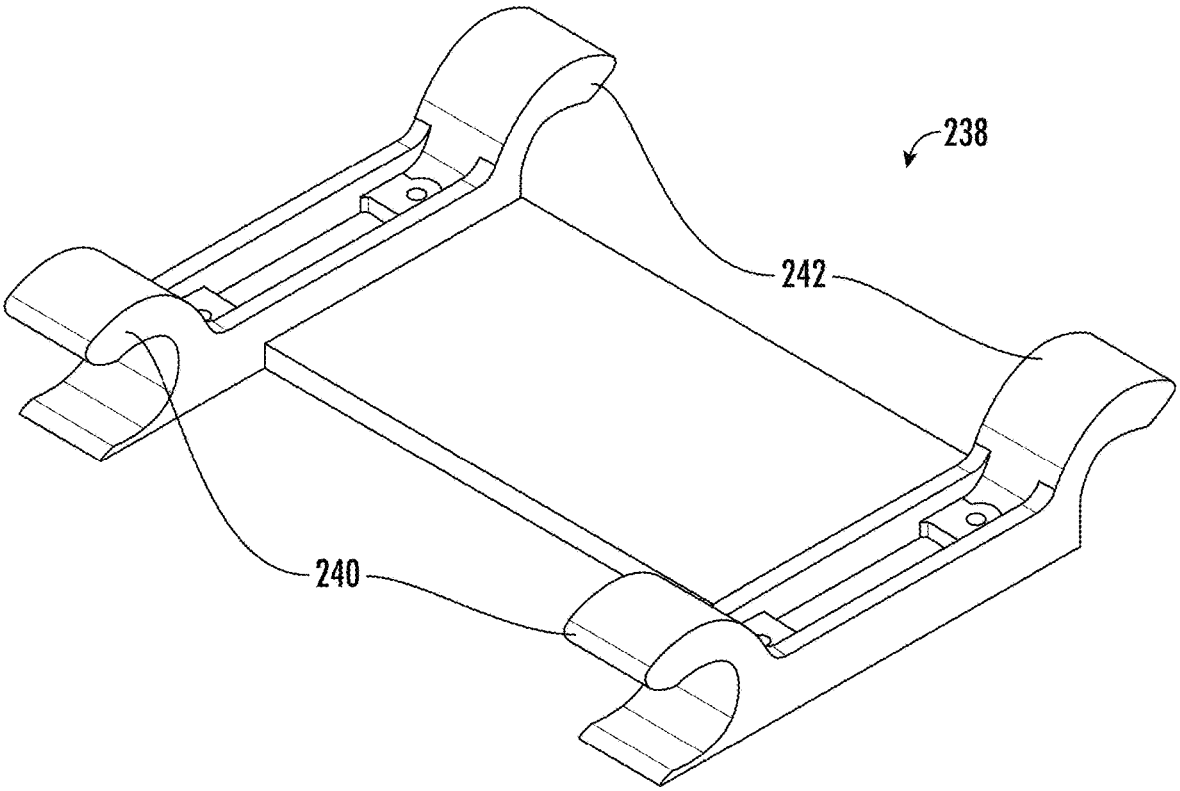
FIG. 12 is a perspective view of the tray catch shown in FIG. 4, in accordance with an embodiment of the invention.

The base front member 234 and base rear member 236 are configured to sit on the retail shelf providing a stable platform for the pusher tray 100. Positioned on top of the base plates 230 is a tray catch 238 with front pair of slide stop clips 240 and a rear pair of slide stop clips 242. FIG. 12 is a perspective view of the tray catch 238 shown in FIG. 11, in accordance with an embodiment of the invention. The front pair of stop clips 240 is designed to receive and hold one of a parallel cylindrical member 115 of the front spacer 112, while the rear pair of stop clips 242 is designed to receive and hold one of the parallel cylindrical members 115 of the rear spacer 113 when the pusher tray 100 slides forward into a loading configuration.

Like the pairs of clips 196 described above, two pairs of stop clips 240, 242 are made to be resilient such that each of the pairs of clips 240, 242 flex to open wider when removably attaching to one of the parallel cylindrical members 115 of spacers 112, 113. The resilient pairs of stop clips 240, 242 then return to their original shape when closing around the cylindrical members 115.

In a normal dispensing configuration, when the pusher tray 100 has the two flange elements 202 inserted and captured within the slot 232, and where the pusher tray 100 is positioned directly over the base 228 such that the entire length of the base 228 is covered by the length of the pusher tray 100, the pair of front stop clips 240 is attached to the front spacer 112. The pusher tray 100 can be transitioned to a loading configuration, in which most of the pusher tray 100 is positioned forward of the base 228, by disengaging the front spacer 112 from the pair of front stop clips 240 and sliding the pusher tray 100 forward from the base 228 until the rear spacer 113 snaps into the pair of rear stop clips 242. The flange elements 202 keep the pusher tray 100 attached to the base 228 in the loading configuration. When the pusher tray 100 is loaded with retail items, the tray 100 can slide back to the dispensing configuration.

Figure 13:
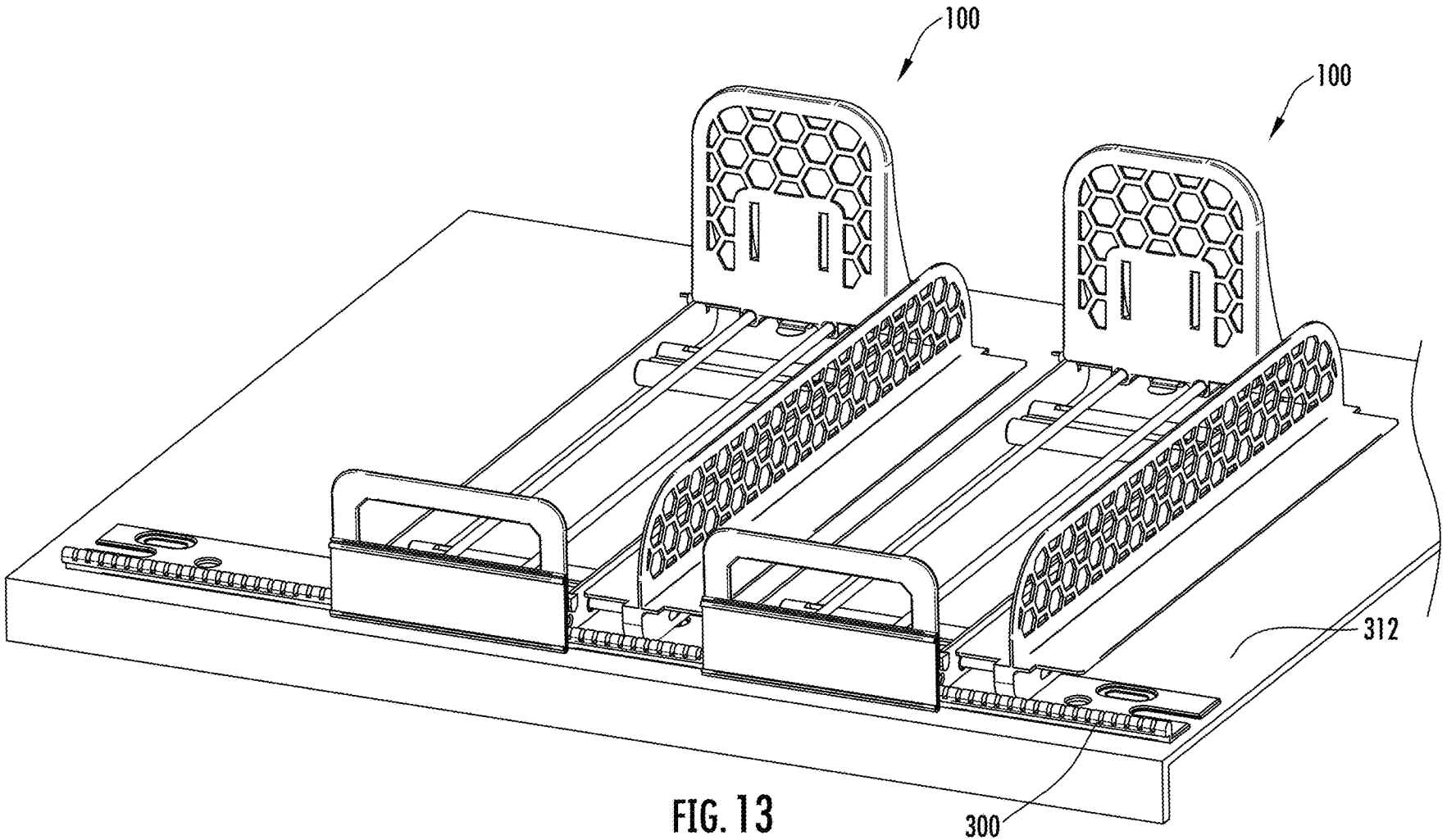
FIG. 13 is a perspective view of another embodiment of a shelf mounting arrangement of the retail merchandise tray system, illustrating multiple retail merchandise tray systems mounted to a mounting rail which receives at least one mounting tab, in accordance with an embodiment of the invention.

FIG. 13 is a perspective view of another embodiment of a shelf mounting arrangement of the retail merchandise tray system, illustrating multiple retail merchandise tray systems mounted to a mounting rail 300 which receives at least one mounting tab 306, in accordance with an embodiment of the invention. FIG. 13 illustrates an embodiment of the pusher tray 100 and base 228 with a shelf mounting arrangement. In this embodiment, one or more pusher trays 100 are mounted to a mounting rail 300, which is in turn mounted or attached directly onto a retail shelf 312. As explained below, each pusher tray 100 snaps into the mounting rail 300 to fix the tray 100 to the retail shelf 312. Although two pusher trays 100 are shown, the mounting rail 300 may be of any length to accommodate a greater number of trays 100.

Figure 14:
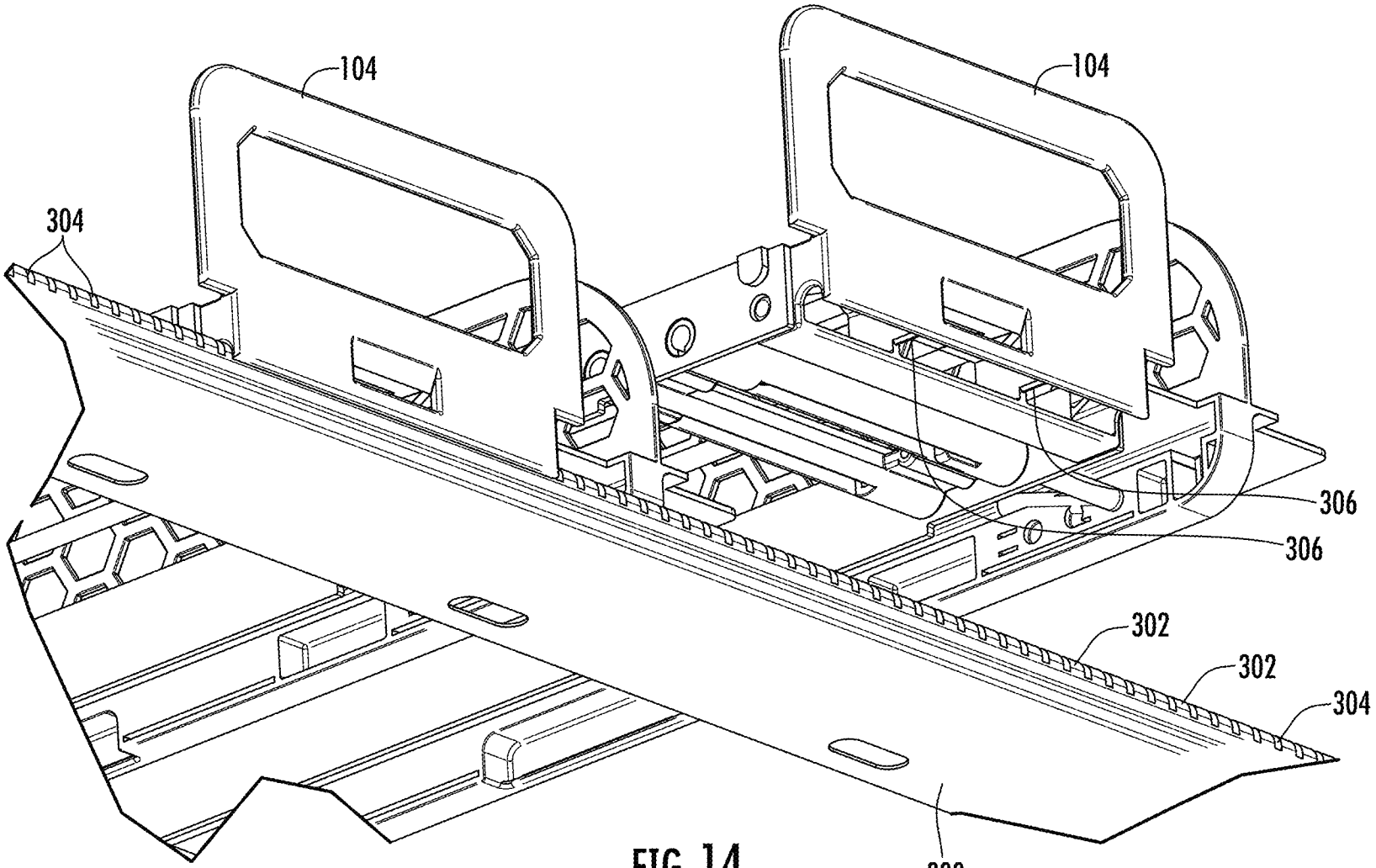
FIG. 14 is a perspective exploded view, illustrating one of the retail merchandise tray systems of FIG. 13 disconnected from the mounting rail to expose at least one mounting tab of the retail merchandise tray system which is received between adjacent teeth of the mounting rail, in accordance with an embodiment of the invention.

FIG. 14 is a perspective exploded view illustrating one of the retail merchandise tray systems of FIG. 13, disconnected from the mounting rail to expose at least one mounting tab 306 of the retail merchandise tray system which is received between adjacent teeth 302 of the mounting rail 300, in accordance with an embodiment of the invention. FIG. 14 illustrates an embodiment in which one of the pusher trays 100 is shown in an exploded view away from the mounting rail 300. As can be seen in this view, mounting rail 300 includes a plurality of teeth 302, with a space 304 formed between each adjacent set of teeth 302. These spaces 304 are configured to receive a mounting tab 306 formed on front stop 104. In the illustrated embodiment, two tabs 306 are utilized, but fewer or greater mounting tabs 306 may be employed. The width of each tab 306 is such that it will tightly fit in each space 304. As a result, the pusher tray 100 may be removably attached to the mounting rail 300.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention, and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A retail merchandise tray system, comprising:

a pusher tray comprising:

a pair of opposed load bearing members;

a front stop mounted to the pair of load bearing members;

a wire support frame supported at least in part by the pair of load bearing members; and a pusher mounted to the wire support frame, the pusher movable along the wire support frame toward and away from the front stop along a first axis;

a base configured for removable attachment to the pusher tray, the base further configured for attachment to a retail shelf; and a tray catch attached to the base, the tray catch having a front pair of slide stop clips and a rear pair of slide stop clips;

wherein the attachment of the base to the pusher tray is such that the pusher tray is configured to slide back and forth between a loading configuration and a dispensing configuration.

2. The retail merchandise tray system of claim 1, wherein the pusher tray includes a carriage slide for attaching the pusher tray to the base, the carriage slide having at least one flange element.

3. The retail merchandise tray system of claim 2, wherein the base includes two parallel base plates that extend along a length of the base, the base plates spaced apart such that a slot extends along a length of the base plates.

4. The retail merchandise tray system of claim 3, wherein the at least one flange element is configured for insertion into the slot for attaching the pusher tray to the base.

5. The retail merchandise tray system of claim 4, wherein the at least one flange element has a neck portion which is narrower than the slot, and a flange plate which is wider than the slot, and following the insertion into the slot, the neck portion is within the slot, the flange plate is below the slot, and the pusher tray is above the slot.

6. The retail merchandise tray system of claim 3, wherein the base plates are attached to a base front member of the base at one end, and attached to a base rear member of the base at another end opposite the one end.

7. The retail merchandise tray system of claim 2, further comprising a front spacer and a rear spacer, each aligned along the first axis and interposed between the pair of load bearing members, and wherein each spacer includes a pair of parallel cylindrical members.

8. The retail merchandise tray system of claim 7, wherein the front and rear spacers are situated below the wire support frame.

9. The retail merchandise tray system of claim 1, further comprising a front spacer and a rear spacer, each aligned along the first axis and interposed between the pair of load bearing members, and wherein each spacer includes a pair of parallel cylindrical members.

10. The retail merchandise tray system of claim 1, wherein the base includes two parallel base plates that extend along a length of the base, the base plates spaced apart such that a slot extends along a length of the base plates, and wherein the tray catch is attached to the base plates.

11. The retail merchandise tray system of claim 1, further comprising a mounting rail configured for mounting to the retail shelf and at least one mounting tab, the mounting rail including a plurality of spaced apart teeth arranged to receive the at least one mounting tab in a space between adjacent teeth.

12. The retail merchandise tray system of claim 11, wherein the mounting rail is attached to a front end of the base.

13. The retail merchandise tray system of claim 11, wherein the mounting rail is attached to a rear end of the base.

14. The retail merchandise tray system of claim 1, further comprising at least one divider assembly movable relative to the pair of opposed load bearing members along a second axis perpendicular to the first axis.

15. The retail merchandise tray of claim 14, wherein the at least one divider assembly includes a pair of divider assemblies movable along the second axis and arranged such that the pair of load bearing members are interposed between the pair of divider assemblies.

16. The retail merchandise tray of claim 14, wherein the at least one divider assembly includes a divider wall and a pair of wire supports, the pair of wire supports removably attached to the divider by a resilient connection.

17. The retail merchandise tray of claim 16, wherein the divider wall includes an upright portion having opposed sides, wherein a flange extends from at least one of the opposed sides perpendicular to the upright portion.

18. The retail merchandise tray system of claim 9, wherein the front pair of slide stop clips is attached to one of the pair of parallel cylindrical members of the front spacer when the pusher tray is in the dispensing configuration.

19. The retail merchandise tray system of claim 9, wherein the rear pair of slide stop clips is attached to one of the pair of parallel cylindrical members of the rear spacer when the pusher tray is in the loading configuration.

* * * * *